United States Patent [19]

Kubsh et al.

[11] Patent Number: 4,854,086

[45] Date of Patent: Aug. 8, 1989

[54] ABRASIVE DISC

[75] Inventors: Leroy M. Kubsh; Donald R. Schlie, both of Roscoe, Ill.

[73] Assignee: Litton Industrial Automation Systems, Inc., Del.

[21] Appl. No.: 542,085

[22] Filed: Oct. 17, 1983

Related U.S. Application Data

[63] Continuation of Ser. No. 303,722, Sep. 21, 1981, abandoned.

[51] Int. Cl.[4] ..... B23F 21/03

[52] U.S. Cl. ..... 51/209 R; 51/209 DL; 411/154

[58] Field of Search ..... 51/209 R, 209 S, 207 DL; 411/154, 155

[56] References Cited

U.S. PATENT DOCUMENTS

| | | | |
|---|---|---|---|
| 2,351,129 | 6/1944 | Jockel | 51/209 R |
| 2,425,368 | 8/1947 | Doermann | 51/209 R X |
| 2,652,321 | 9/1953 | Teague | 51/209 L X |
| 2,836,017 | 5/1958 | Tygh | 51/209 R |
| 3,060,538 | 10/1962 | Simi | 411/155 |
| 4,193,434 | 3/1980 | Wagner | 411/154 |

FOREIGN PATENT DOCUMENTS

| | | | |
|---|---|---|---|
| 481228 | 3/1938 | United Kingdom | 411/155 |

*Primary Examiner*—Frank T. Yost
*Assistant Examiner*—Willmon Fridie, Jr.
*Attorney, Agent, or Firm*—Morris I. Pollack

[57] ABSTRACT

An abrasive disc comprising a bonded abrasive body having a substantially flat mounting surface, a plurality of anchors each including a cup-shaped metallic washer having a flat top surface portion substantially flush with the flat mounting face and an annular outwardly inclined skirt portion embedded within the abrasive body, each washer including a first plurality of apertures in the skirt portion whereby integral portions of the bonded abrasive body extending therethrough lock the washer in position within the bonded abrasive, and a second plurality of apertures in the flat top surface portion filled with abrasives for decreasing the metallic surface area of the washer.

2 Claims, 1 Drawing Sheet

ABRASIVE DISC

This application is a continuation of Ser. No. 303,722 filed Sept. 21, 1981, now abandoned.

The invention relates to abrasive discs for use in conjunction with disc grinding machines.

Disc grinding machines generally employ at least one rotatable spindle having a mounting plate secured at one end. A bonded abrasive disc, releasably secured to this plate, effects stock removal from a workpiece. Ideally, the abrasive disc and mounting plate have precisely flat mounting faces so that the abrasive disc may be properly secured to the mounting plate by bolts which extend through the mounting plate and threadedly engage the cup-shaped metallic anchors embedded in the mounting face of the abrasive disc.

During the manufacturing process, the mounting face of the abrasive disc must accordingly be trued or dressed to an acceptable degree of flatness. This truing operation would heat these anchors to an undesirable temperature which could damage the anchor and/or surrounding abrasive if truing resulted in the engagement of the truing tool and the anchor.

Accordingly, a non-metallic, abradable flat washer is glued to the metallic anchors and defines with the bonded abrasive the untrued mounting face of the abrasive disc. The metallic anchor is thereby recessed from the mounting face and shielded during the truing process as described in U.S. Pat. No. 2,418,883. Such additional washers, however, add substantially to the cost of the mounting anchors and reduces the effective engagement of the threads of the mounting screws in the inserts. The variation in thickness of the washers after truing will change the number of threads engaged. If longer screws are used to accommodate the washers, they could be too long for mounting discs tht do not have washers and thus pull the inserts loose in mounting the disc to the customer's steel wheel.

It is, accordingly, an object of the present invention to provide an abrasive disc having improved mounting anchors.

Other objects and advantages of the present invention will become apparent from the following portion of this specification and from the accompanying drawings which illustrate, in accordance with the mandate of the patent statutes, a presently preferred embodiment incorporating the principles of the invention.

Referring to the drawings.

Figure 1:
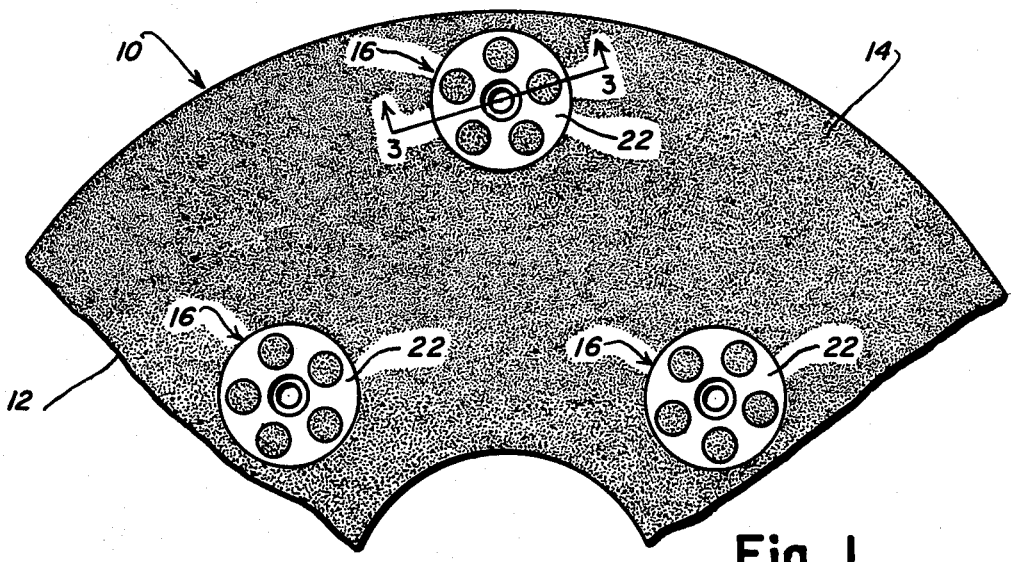
FIG. 1 is an elevational view of a portion of an abrasive disc made in accordance with the teachings of the present invention.
Figure 2:
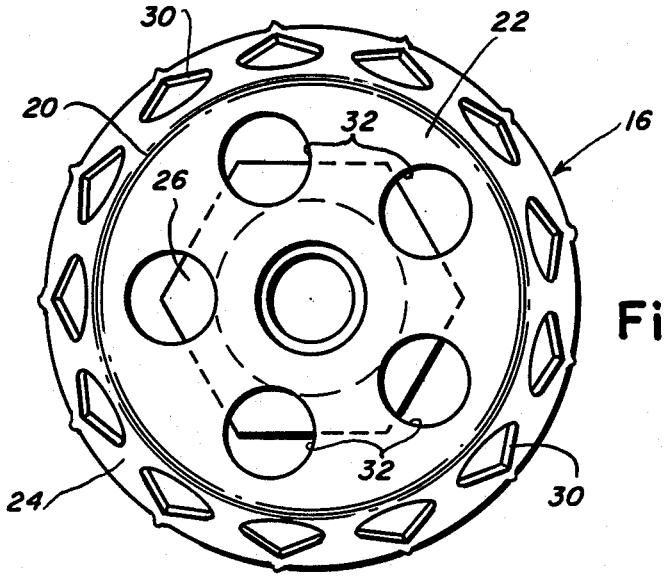
FIG. 2 is an elevational view of a disc mounting anchor illustrated in FIG. 1.

The untrued abrasive disc 10 includes a bonded abrasive body 12 having a substantially flat mounting surface or face 14 and a plurality of mounting anchors 16 which are embedded therein. Each anchor 16 (FIG. 2) includes a cup-shaped metallic washer 20 having a flat top surface 22 and a downwardly extending, outwardly inclined annular side wall or skirt 24. A nut, preferably one with a taper, 26 is secured to the bottom of the flat portion of the washer. Such a structure having no apertures other than for receiving an attachment bolt and having a non-metallic abradable washer secured to the top surface is definitive of prior art anchoring structures.

Figure 3:
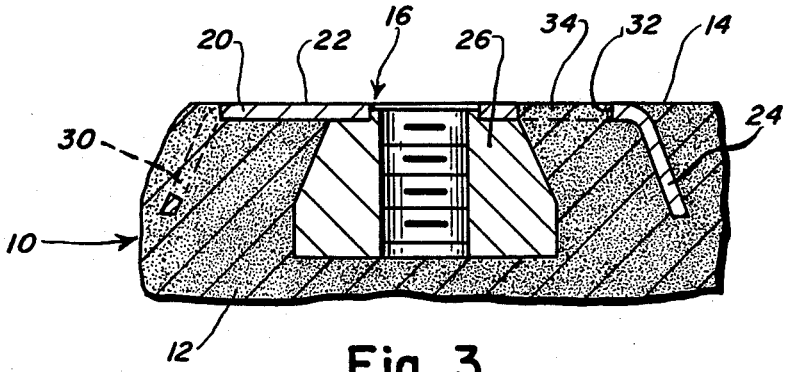
FIG. 3 is a sectional view along the line 3—3 of FIG. 1.

According to the present invention, a plurality of apertures 30 are defined in the skirt 24 of the washer 20 through which pass integral portions of the abrasive body 12 positively locking the anchor in its embedded position (FIG. 3) whereat the flat top surface 22 of the washer lies in the plane of the abrasive body mounting surface 14.

A second plurality of apertures 32 are defined in the flat top surface 22 of the washer 20 thereby decreasing the metallic surface area of this portion. These apertures 32 of an embedded anchor (FIG. 3) are filled by the bonded abrasive defining portions 34 of the mounting surface 14. When the mounting face is trued, the temperature of the metallic anchor will not reach a level which could damage the anchor and/or abrasive due to the reduction in surface area of the top portion of the washer 20. Furthermore, the loose abrasive particles released from the portions 34 of the bonded abrasive surface located within these apertures 32 tends to act as loose abrasive material as encountered in shot siding or free abrasive lapping. The free abrasive removes metal from the insert and also keeps the truing tool sharp to cut cooler.

What is claimed is:

1. An abrasive disc comprising:

a bonded abrasive body having a substantially flat mounting surface, a plurality of anchoring means each including a cup-shaped metallic washer having a flat top surface portion substantially flush with said flat mounting face and an annular outwardly inclined skirt portion embedded within said abrasive body, each said washer including an internally threaded portion communicating with an opening in said flat top surface portion for receiving a bolt, a plurality of apertures in said skirt portion surrounding said top surface opening whereby integral portions of said bonded abrasive body extending therethrough lock said washer in position within said bonded abrasive, and a plurality of apertures in said flat top surface portion surrounding said top surface for decreasing the metallic surface area of said washer bottom surfaces wherein bonded abrasive fills said plurality of apertures in said flat top surface portion.

2. An abrasive disc according to claim 1, wherein said internally threaded portion comprises a nut.

* * * * *